US005501570A

United States Patent [19]

Mozingo

[11] Patent Number: 5,501,570

[45] Date of Patent: Mar. 26, 1996

[54] ANTI-ROLLBACK MECHANISM FOR A LOADER MECHANISM OF AN OFF-HIGHWAY IMPLEMENT

[75] Inventor: Robert E. Mozingo, Burlington, Iowa

[73] Assignee: Case Corporation, Racine, Wis.

[21] Appl. No.: 183,703

[22] Filed: Jan. 21, 1994

[51] Int. Cl.[6] ..... B66C 23/00

[52] U.S. Cl. ..... 414/700; 414/709; 74/471 X Y

[58] Field of Search ..... 414/700, 701, 414/706, 709, 710, 712, 714; 74/471

[56] References Cited

U.S. PATENT DOCUMENTS

| | | | |
|---|---|---|---|
| 3,402,840 | 4/1968 | Goth | 414/701 |
| 3,521,781 | 7/1970 | Holsinger et al. . | |
| 3,522,897 | 8/1970 | Freedy | 414/701 |
| 3,539,068 | 11/1970 | Seaberg | 414/701 |
| 3,568,869 | 3/1971 | Beiley | 414/701 |
| 3,794,199 | 2/1974 | Bromberek | 414/700 |
| 4,018,352 | 4/1977 | Lindstrom . | |
| 4,372,729 | 2/1983 | Buschbom et al. | 414/700 |
| 4,375,344 | 3/1983 | Baum et al. | 414/709 |
| 4,431,364 | 2/1984 | Redenbarger et al. | 414/706 |
| 4,452,559 | 6/1984 | Speers et al. | 414/706 |
| 4,966,518 | 10/1990 | Kourogi et al. | 414/700 |

*Primary Examiner*—David A. Bucci
*Assistant Examiner*—Gregory A. Morse
*Attorney, Agent, or Firm*—Rudnick & Wolfe

[57] ABSTRACT

An anti-rollback mechanism is provided for an off-highway implement having a mobile frame and a loader mechanism including a bucket pivotally attached between lift arms of the loader mechanism. The lift arms are connected to the frame of the implement and lift actuators are used to angularly move the lift arms to elevationally position the bucket. Tilt actuators connected to the bucket and to the lift arms effect rolling movements of the bucket relative to the lift arms. A single handled control mechanism regulates operation of the tilt and lift actuators through hydraulic tilt and lift valves. The anti-rollback mechanism of the present invention automatically positions the tilt valve as the lift arms move through a predetermined range of angular movements relative to the frame to prevent rollback of the bucket past a generally level position as the lift arms and bucket are elevated.

14 Claims, 4 Drawing Sheets

ANTI-ROLLBACK MECHANISM FOR A LOADER MECHANISM OF AN OFF-HIGHWAY IMPLEMENT

FIELD OF THE INVENTION

The present invention generally relates to off-highway implements equipped with loader mechanisms and, more specifically, to an anti-rollback mechanism for automatically positioning a bucket of a loader mechanism to prevent inadvertent dumping of the contents of the bucket.

BACKGROUND OF THE INVENTION

Material handling implements of the type under consideration are well known. These off-highway implements embody a frame with a pair of lift arms pivotally connected to the frame. A material handling unit, such as a bucket, is pivotally connected to and between opposite ends of the respective lift arms. Lift actuators are connected between the frame of the implement and the lift arms for elevationally positioning the bucket relative to the frame of the implement. Tilt actuators are connected between the lift arms and the bucket for effecting pivotal fore-and-aft movement of the bucket to dump the contents thereof.

During normal operation, the lift arms are in a lowered position such that the bucket is positioned to have a lower edge or wall thereof generally flat with respect to the ground to facilitate filling the bucket. After the bucket is filled, it is tilted or rolled back with respect to the lift arms to maintain the contents within the bucket as it is raised to a position to enable dumping of the bucket or transfer the contents to some other location. As the lift arms are raised, it is necessary for the bucket to the pivoted with respect to the lift arms to maintain the bucket in a generally level position and prevent spilling of the contents.

Many implements having loader mechanisms attached thereto utilize a single handle control mechanism for both elevating the bucket and for dumping the bucket. During operation of the implement, however, it is not unusual for the operator to become confused and/or inadvertently move the single handle control in a wrong direction resulting in rolling movement of the bucket. Inappropriate rolling movements of the bucket when the lift arms are raised above the operator station can and often does result in the dumping of the materials onto the operator station of the implement.

Thus, there is a need and a desire for an anti-rollback mechanism which does not interfere with normal operation of the single handled control and yet automatically adjusts the position of the bucket relative to the lift arms as a function of the angular disposition of the lift arms relative to the frame of the implement.

SUMMARY OF THE INVENTION

In view of the above, and in accordance with the present invention, there is provided an anti-rollback mechanism for use with off-highway implements having a mobile frame and a loader mechanism including a bucket pivotally attached between lift arms of the loader mechanism. The lift arms are pivotally connected to the frame and lift actuators are used to angularly move the lift arms to elevationally position the bucket relative to the frame. Tilt actuators connected to the bucket and to the lift arms control the rolling movements of the bucket relative to the lift arms. The anti-rollback mechanism is designed to automatically position the bucket relative to the lift arms to prevent rollback of the bucket past a generally level position as the lift arms are raised through a predetermined range of angular movement relative to the frame of the implement.

As is conventional, operation of the loader mechanism is effected through a single control lever. The control lever is mounted to a frame of the implement for fore-and-aft movements as well as transverse movements relative to a neutral position. The control lever is connected through linkages to valve structure including a lift valve and a tilt valve. Fore-and-aft movements of the control lever are transmitted through a first linkage to manipulate the lift valve and thereby control the elevation of the bucket relative to the frame while transverse movements of the control lever are transmitted through a second linkage to manipulate the tilt valve and thereby control rolling movements of the bucket. As will be appreciated by those skilled in the art, it is sometimes desirable to roll the bucket back past its level position when the lift arms are lowered into a digging or dozing position. When the lift arms are so lowered, there is no danger of dumping the load onto the operator and rollback of the bucket beyond the level position can be of assistance in breaking out the bucket as it digs into a load.

The anti-rollback mechanism of the present invention readily allows the bucket to be rolled past its level position when the lift arms are in a lower position and yet automatically levels the bucket as the lift arms are moved to a raised position. In the present invention, the anti-rollback mechanism automatically engages and adjusts the tilt valve to effect generally leveling of the bucket as by tilting the bucket relative to the lift arms as the lift arms are moved to a raised position. The anti-rollback mechanism of the present invention automatically engages and adjusts the tilt valve after the lift arms are moved through a predetermined angle away from the ground surface thereby effecting the tilting of the bucket into a predetermined position relative to the lift arms to prevent materials carded within the bucket from spilling backwards onto the operator.

In a preferred form of the invention, the anti-rollback mechanism includes an anti-rollback shaft mounted on the frame of the implement for rocking movement about a fixed axis. A first end of the shaft is connected to a control member which rocks the shaft about its axis in response to the lift arms of the loader mechanism being moved through a predetermined angle relative to the frame. The second end of the rollback shaft is adapted to move the linkage connecting the control lever to the tilting valve thereby effecting operation of the actuators used to maintain the bucket in a predetermined disposition relative to the loader arms. In a most preferred form of the invention, the anti-rollback shaft has a predetermined range of free rocking movement to allow a free range of elevational bucket movement as the bucket moves through a lower range of its vertical movements. That is, the anti-rollback shaft has a predetermined free range of free rocking movement before it becomes operably associated with the second linkage used to move and position the tilt valve. In a most preferred form of the invention, one end of the anti-rollback shaft is provided with a camming surface which is adapted to engage a follower plate arranged in combination with the linkage connecting the control lever with the tilting valve.

The control rod of the anti-rollback mechanism is preferably connected through a motion transfer mechanism to the anti-rollback shaft on the frame of the implement. The motion transfer mechanism preferably includes a cable for further allowing a predetermined angle of pivotal movement of the lift arms relative to the frame without imparting rocking movements to the shaft. Preferably, a spring mechanism is used for biasing the anti-rollback shaft out of engagement with the linkage connecting the control member to the tilt valve.

The use of the anti-rollback shaft as part of the anti-rollback mechanism allows the transmission of torque over a considerable distance. Moreover, the rollback shaft is configured such that the control lever is moved in a proper ratio relative to the elevational lift of the lift arms relative to the frame of the machine. The use of an anti-rollback shaft arranged for rocking movement about a fixed axis substantially reduces the number of parts, fits in a very confined space and automatically moves the bucket into a leveling position as the lift arms are moved into a raised position. An advantage of the present invention being that the anti-rollback mechanism does not interfere with normal operation of the single handled control and yet automatically moves the control lever and thereby lessens the burden on the operator to maintain the bucket in a level position to prevent dumping of the materials onto the operator area of the frame.

Numerous other advantages and features of the present invention will become readily apparent from the following detailed description of the invention from the attached claims, and from the accompanying drawings.

DETAILED DESCRIPTION OF THE DRAWINGS

DETAILED DESCRIPTION OF A PREFERRED EMBODIMENT

Figure 1:
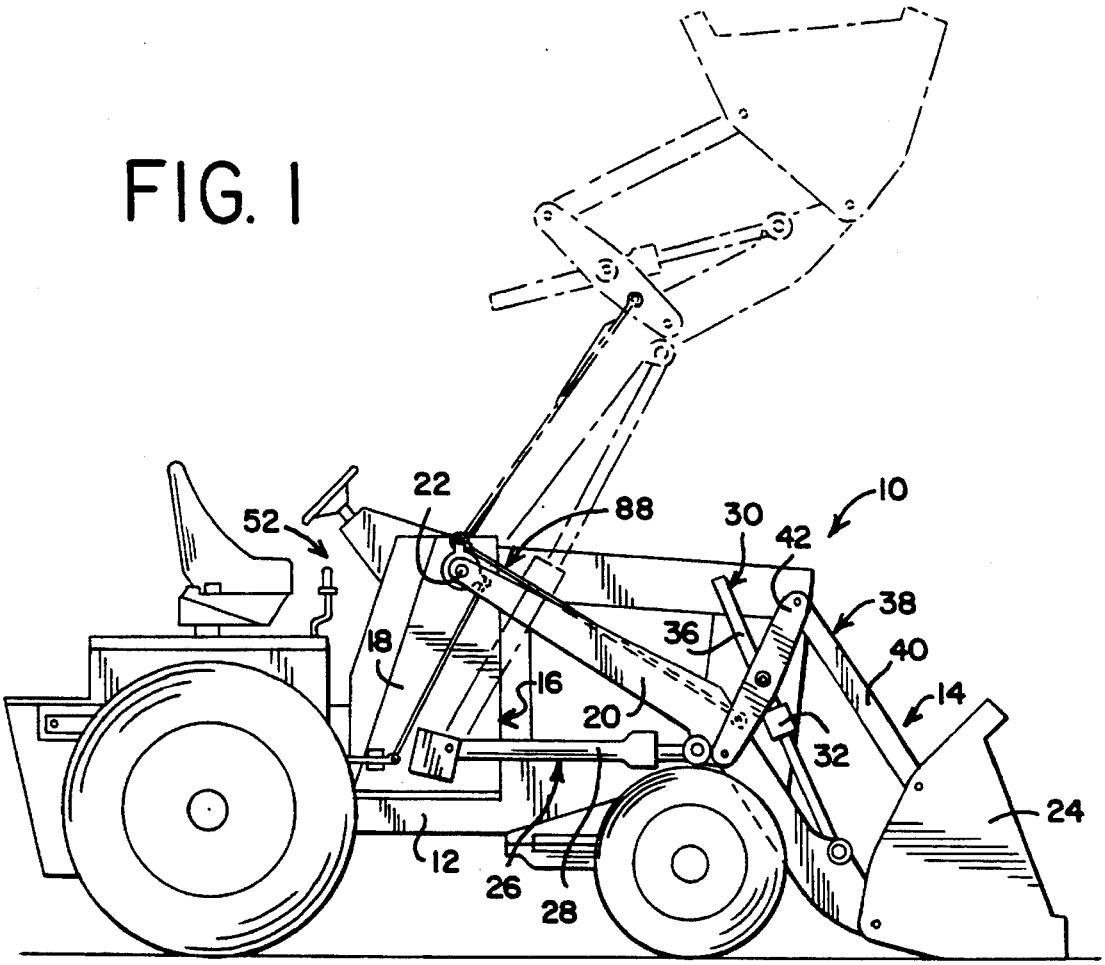
FIG. 1 is a side elevational view of an off-highway implement equipped with a loader mechanism and an anti-rollback mechanism of the present invention attached thereto.

While the present invention is susceptible of embodiment in various forms, there is shown in the drawings and will hereinafter be described a preferred embodiment of the invention with the understanding that the present disclosure is to be considered as setting forth an exemplification of the invention which is not intended to limit the invention to the specific embodiment illustrated.

Referring now to the drawings, wherein like reference numerals indicate like parts throughout the several views, in FIG. 1 there is shown an off-highway implement 10 including a mobile main frame 12 having a loader mechanism 14 mounted thereon. The loader mechanism 14 includes a frame 16 that is attached to the implement by any suitable means. The frame 16 serves a support of the loader mechanism and includes a pair of vertically upstruck supports 18 (only one being shown) arranged on opposite lateral sides of the implement frame.

The loader mechanism 14 further includes a pair of generally parallel lift arms 20. In the illustrated embodiment, each lift arm is connected as by a pivot shaft 22 to an upper end of a respective support 18. A bucket 24 is pivotally connected to and between the distal ends of the lift arms 20.

As is conventional, each lift arm 20 is angularly displaced relative to the frame 12 and pivoted about the pivot shaft 22 as through a suitable lift actuator 26 connected between the respective lift arm and support 18. In the illustrated embodiment, a pair of extendable/retractable hydraulic cylinders 28 (only one being shown) are used to angularly position the lift arms 20 and thereby the bucket 24 relative to the frame 12. In the illustrated embodiment, hydraulic pressure may applied to either end of the cylinders 28. When hydraulic pressure is applied to the piston end, the lift cylinders 28 are distended and the lift arms 20 are raised by pivoting about the pivot shaft 22. Conversely, when pressure is applied to the rod end, the lift cylinders 28 retract and the lift arms 20 are pivoted in an opposite direction to lower the bucket 24 attached to the end of the arms.

The bucket 24 is pivoted or rolled between carrying and unloading positions by at least one tilt actuator 30. In the illustrated embodiment, the tilt actuator includes an extendable/retractable tilt cylinder 32. In the illustrated embodiment, the piston rod 34 of the tilt cylinder 32 is articulately connected or coupled to the lift arms 20 near the end thereof, while the cylinder portion 36 of the tilt cylinder 32 is coupled to the bucket 24 through a bucket positioning linkage 38. This bucket positioning linkage is identical for both lift arms 20 and therefore, only one such arrangement will be described.

The bucket positioning linkage 38 includes a forward bucket link 40, one end of which is pivotally secured to the bucket 24 and the opposite end of which is pivotally connected to the end of a rear bucket link 42. The opposite end of the rear bucket link 42 is pivotally connected to an intermediate portion of the lift arm 20. It can thus be seen that pivotal movement of the rear bucket link 42 causes pivotal or rolling movements of the bucket 24 relative to the lift arms 20. To effectuate movement of the rear bucket link 42, the cylinder portion 36 of the hydraulic tilt cylinder 32 is pivotally connected thereto intermediate its ends.

Application of hydraulic pressure to the rod end of the tilt cylinder 32 causes the bucket 24 to pivot or roll rearwardly relative to the lift arms 20, i.e., to rollback from the dump position to a carry or level position. Conversely, application of hydraulic pressure to the piston end of the tilt cylinder 32 causes the bucket 24 to pivot or roll forwardly. It will be appreciated, of course, that the two bucket positioning linkages 38 operate simultaneously to bring about the desired results.

Figure 2:
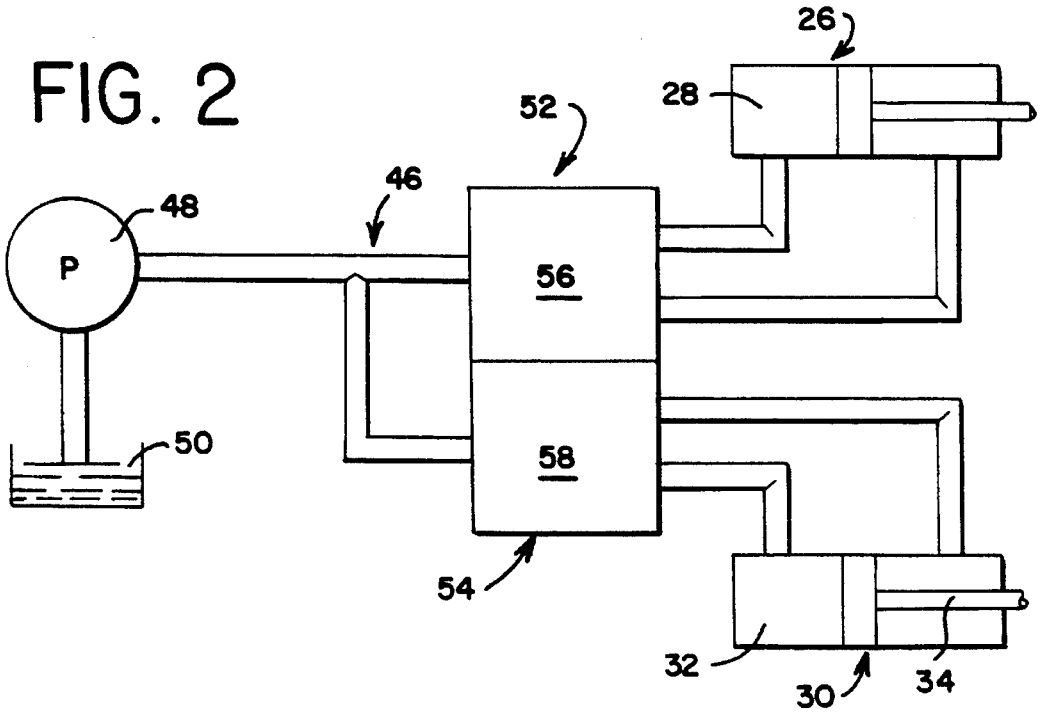
FIG. 2 is a schematic diagram of hydraulic circuitry associated with the loader mechanism.

Turning now to FIG. 2, the implement 10 is further provided with a hydraulic system 46 including the lift cylinders 28 and tilt cylinder 32. The hydraulic system 46 further includes a pressurized hydraulic fluid source such as a pump 48 which draws fluid from a sump 50 arranged on the frame 12 of the implement 10 (FIG. 1). Fluid flow through the hydraulic system and to and from the lift cylinders and tilt cylinder 28 and 32, respectively, in a manner operating the loader mechanism 14 is effected through a conventional single handled control mechanism 52 connected to a hydraulic valve body 54 including a lift valve 56 and a tilt valve 58.

Figure 3:
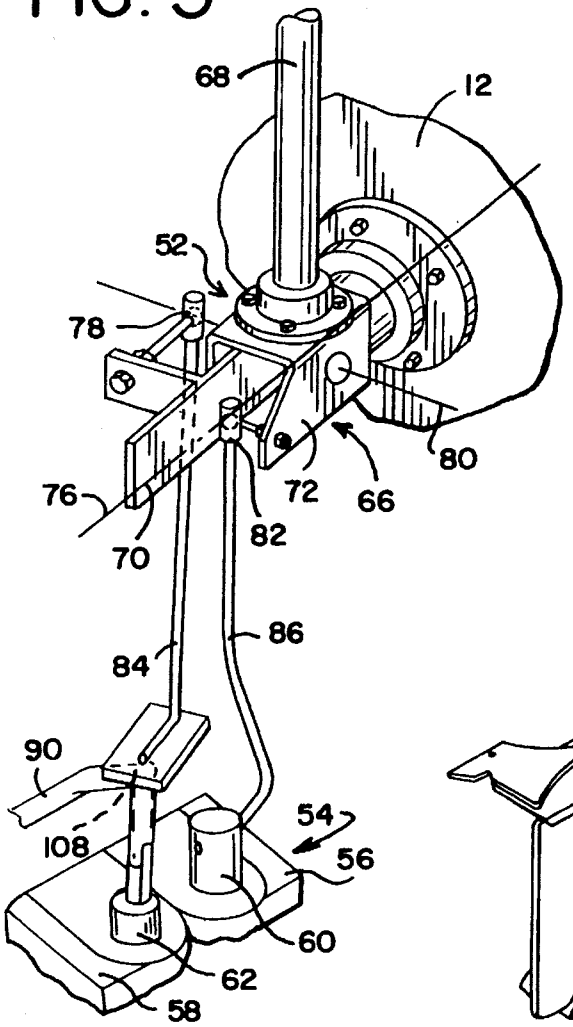
FIG. 3 is a perspective view of a single handed control mechanism and valve structure for controlling operation of the loader mechanism.

The valve body 54 is connected to the pressurized fluid source 48 and is preferably mounted on the frame 12 of the implement. As shown in FIG. 3, the lift valve 56 includes a valve stem 60 which linearly positions a spool valve (not shown) thereby regulating fluid flow through the valve 56 and thereby controlling the "operative length" of the lift cylinders 28. As will appreciated, the operative length of the lift cylinder controls the angular disposition of the lift arms 20 relative to the frame 12 of the implement. The tilt valve 58 likewise includes a valve stein 62 which linearly positions a spool valve (not shown) thereby regulating fluid flow through the valve 58 and thereby controlling the "operative length" of the tilt cylinder 32. As will be appreciated, the operative length of the tilt cylinder controls the pivotal disposition of the bucket 24 relative to the loader arms 20. As used herein, the term "operative length" is meant to define the effective distance between those locations on the respective cylinder or actuator which controls the position of the particular mechanism connected thereto.

As shown in FIG. 3, the single handled control mechanism 52 for controlling the loader functions preferably includes a controller 66 for mounting a single control lever or handle 68 to the frame 12 of the implement 10 for movement in four different directions, with each direction extending away from a neutral position. That is, the controller 66 is capable of independently and conjointly operating the valves 56 and/or 58 thereby controlling the lift and tilt functions of the loader mechanism in response to movements induced thereto by the control handle 68.

In the illustrated embodiment, the controller 66 includes first and second interconnected bracket assemblies 70 and 72 respectively. The first bracket assembly 70 serves to mount the controller 66 to the frame 12 and, more particularly, allows manipulation or movement of the control handle 68 in a first control arc centered about a first pivot axis 76. The first bracket assembly 70 includes a first actuator 78 that is responsive to movements of the first bracket assembly 70 about axis 76 and operative to effectively control the tilt functions of the bucket 24.

In the illustrated embodiment, the second bracket assembly 72 is pivotally connected to and movable with the first bracket assembly 72 and allows manipulation or movement of the control handle 68 about a second pivot axis 80. Notably, the pivot axes 76 and 80 extend generally normal to each other. The second bracket assembly 72 includes a second actuator 82 that is responsive to movements of the bracket assembly 72 about the pivot axis 80 and is operative to effectively control the lift functions of the bucket 24 relative to the lift arms 20 (FIG. 1). In the illustrated embodiment, the actuator 82 is disposed in substantially the same horizontal plane as actuator 78 when the control handle 68 is in a neutral position.

Notably, the bracket assembly 70 is mounted to the loader frame to allow for rotation of the controller 66 about axis 76 while inhibiting endwise movement of controller along axis 76. Moreover, it should be noted that the actuator 78 is radially spaced from the first pivot axis 76 and lies on the pivot axis 80. Similarly, actuator 82 is radially spaced from pivot axis 80 and lies on the first pivot axis 76. Accordingly, fore-and-aft movements of the control handle 68 impart movements to the actuator 82 while having substantially no effect on actuator 78 and thereby substantially no effect on tilting movements of the bucket movements controlled by actuator 78. Conversely, transverse movements of the control handle 68 about axis 76 will result in movement of the actuator 78 while imparting substantially no movement to the actuator 82 and thereby substantially no effect on elevational movements of the bucket 24 controlled by actuator 82.

The first or tilt actuator 78 of the controller 66 preferably includes a spherical coupling or ball joint which is connected through suitable linkage 84 to the valve stem 62 of valve 58. Accordingly, upon induced rotation of the controller 66 about axis 76, the actuator 78 moves to either side of a neutral position resulting in displacement of the valve spool of valve 58 to effect operation of the hydraulic tilt cylinder 32 and thereby causing a tilting or rolling action of the bucket 24 relative to the lift arms 20.

Similarly, the second lift actuator 82 of the controller 66 preferably includes a spherical coupling or ball joint connected through suitable linkage 86 to the valve stem 60 of the lift valve 58. Accordingly, upon induced rotation of the controller 66 about axis 80, the second actuator 82 moves to either side of a neutral position resulting in displacement of the valve spool of valve 56 to effect operation of the hydraulic lift cylinders 28 thereby causing the lift arms 20 to angular move relative to the frame 12 of the implement 20.

As will be appreciated, control over the hydraulic tilt cylinder 32 may be effected conjointly or independently of the angular position of the lift arms 20. Accordingly, the tilt cylinder can be operated to pivot the bucket 24 fully in either direction at any angular position of the lift arms. In the event of operator error, the bucket 24 could be tilted rearwardly i.e., rolled back, thereby inadvertently dumping a load on the implement if the lift arms 20 are raised to a sufficient elevation. Of course, this can be quite dangerous to the operator particularly when large loads are being handled by the bucket 24.

In accordance with the present invention and as illustrated in FIG. 1, there is provided an anti-rollback mechanism 88 for automatically maintaining the bucket 24 in a generally level condition as the lift arms 20 are raised through a predetermined angle relative to the frame 12 of the implement while permitting a full range of movement of the bucket 24 relative to the loader arms 20 when the arms 20 are operated in a lower range of movement relative to the frame of the implement. The anti-rollback mechanism 88 of the present invention is associated with and automatically positions the tilt valve 58 in response to elevational movements of the loader arms 20 through a predetermined angle. Of course, positioning movements imparted to the tilt valve 58 effects operation of the hydraulic tilt cylinder 32 thereby positioning the bucket 24 in a predetermined disposition relative to the loader arms 20.

Figure 6:
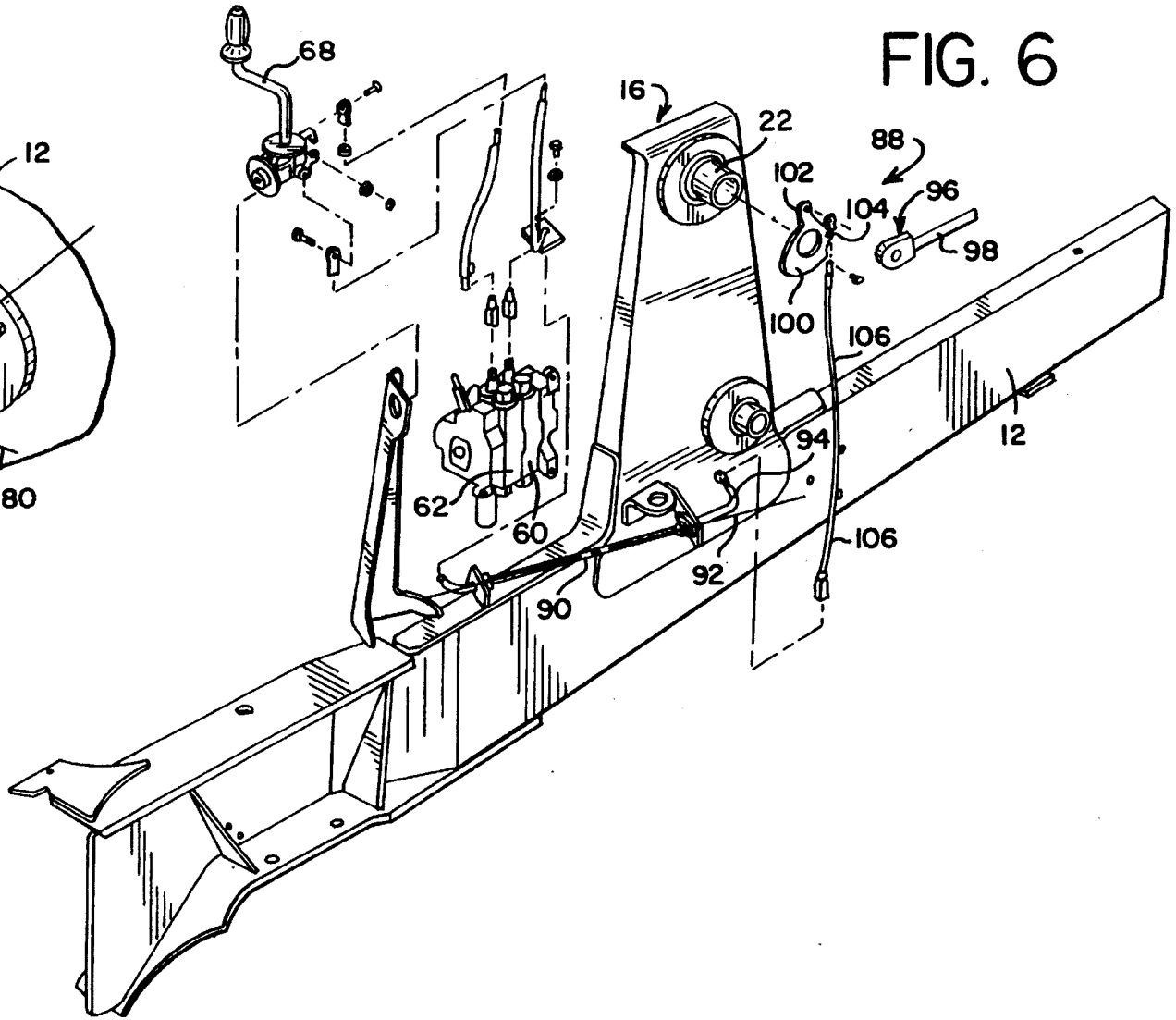
FIG. 6 is a fragmentary perspective view of the anti-rollback mechanism of the present invention.
Figure 4:
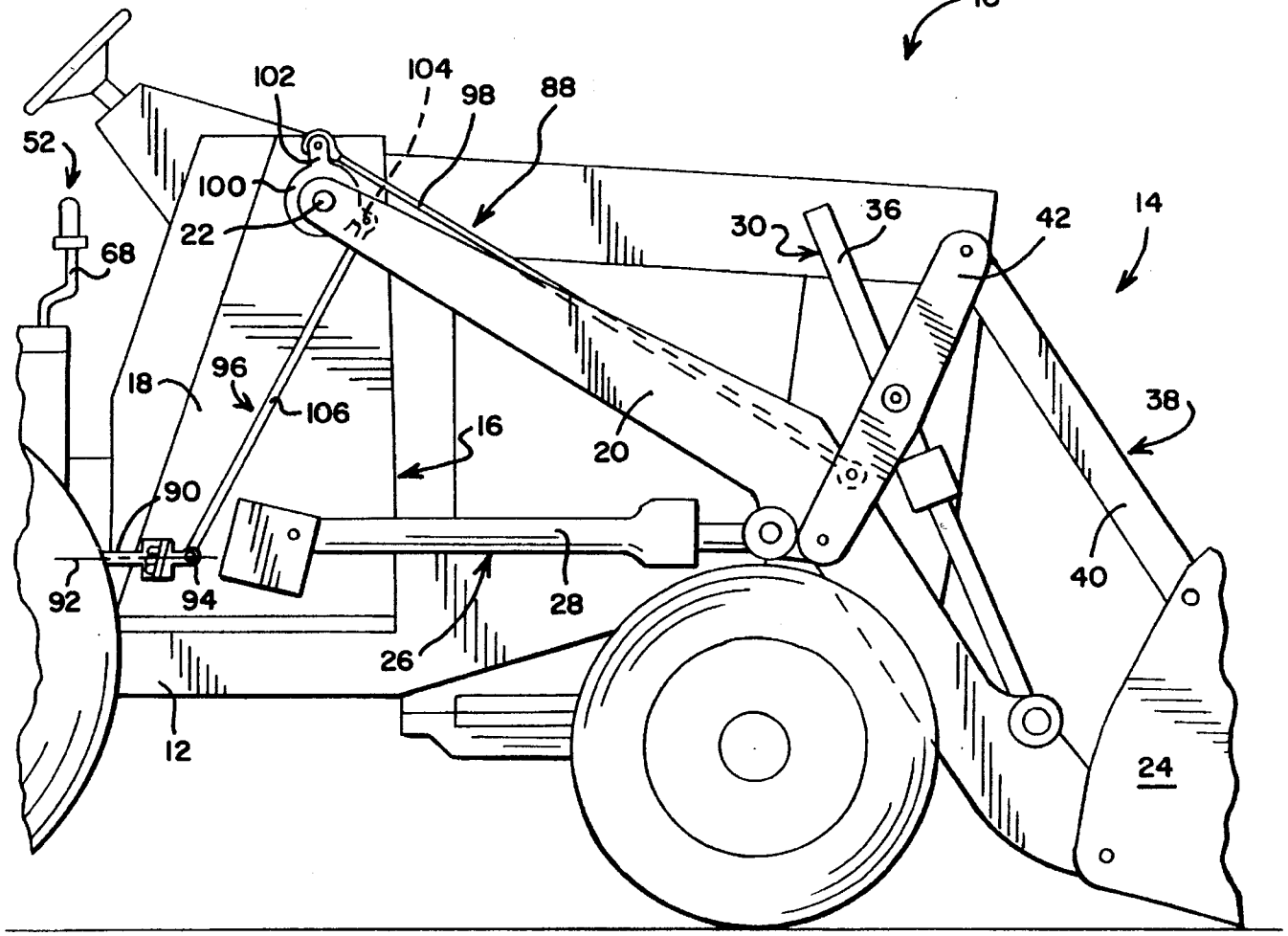
FIG. 4 is an enlarged fragmentary side elevational view showing in more detail the anti-rollback mechanism of the present invention.
Figure 5:
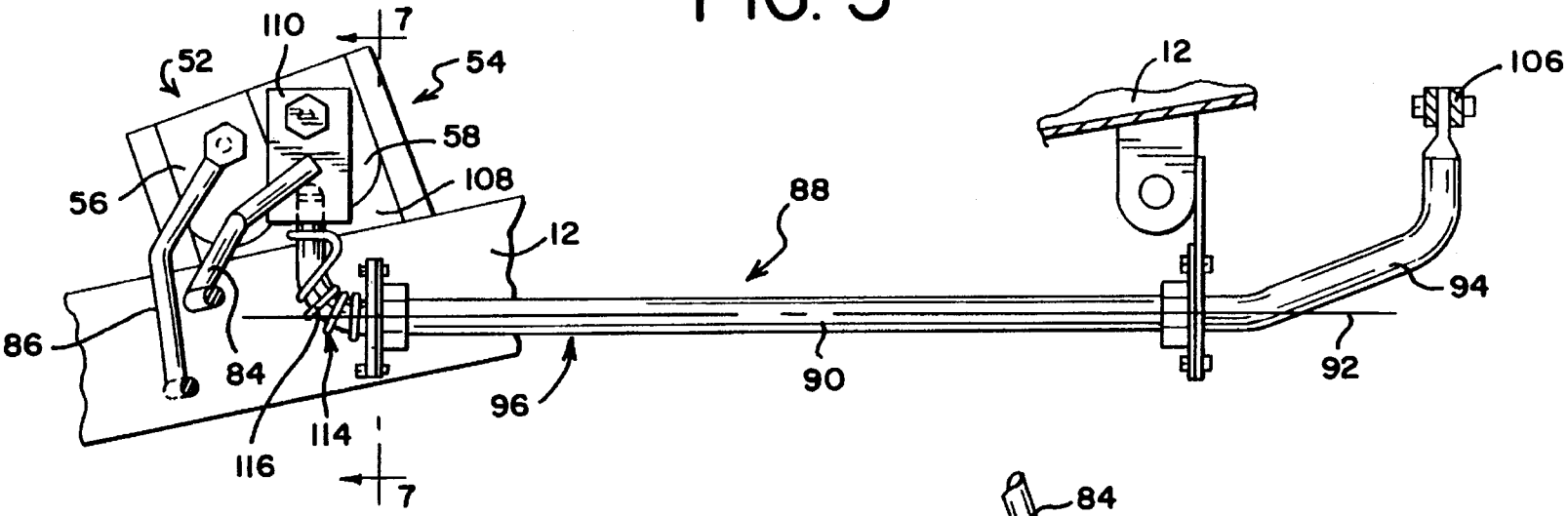
FIG. 5 is a top plan view of some of the parts illustrated in FIG. 4.

Turning now to FIGS. 4, 5 and 6, the anti-rollback mechanism 88 of the present invention includes an anti-rollback shaft 90. Shaft 90 is mounted on the frame 12 of the implement for rocking movement about a generally horizontal and fixed axis 92. Notably, the shaft 90 is mounted on the frame 12 to prevent endwise movement of the shaft 90 along axis 92. One end of shaft 90 is provided with an offset leg portion 94 that preferably extends radially away from the axis 92 of the shaft 90. As will be described in detail below, the opposite end of shaft 90 is operably associated with the linkage 84 connecting the controller 66 to the valve stem 62 of the tilt valve 58.

As shown in FIGS. 4 and 6, a motion transfer mechanism 96 extends from the leg portion 94 and automatically rocks shaft 90 about axis 92 in response to a predetermined range of pivotal movement of the lift arms 20 relative to the frame 12. The motion transfer mechanism 96 preferably includes an elongated and rigid control member or rod 98. In the illustrated embodiment, rod 98 has a fixed length between opposite ends thereof. One end of rod 98 is articulately connected to the rear bucket link 42 of the bucket positioning linkage 38. An opposite end of rod 98 is articulately connected to a member 100 preferably mounted on the frame 16 of the loader mechanism for pivotal movement about a fixed axis. In the illustrated embodiment, member 100 is configured as a bellcrank lever which is preferably mounted for rotation about pivot shaft 22. One leg 102 of the lever 100 is articulately connected to the control rod 98. A second leg 104 of the bellcrank lever 100 is connected to leg portion 94 of shaft 90. In a most preferred form of the invention, and for reasons to be described in detail hereinafter, a cable 106 is used to interconnect the second leg 104 of the bellcrank lever 100 with the leg portion 94 of shaft 90.

Figure 7:
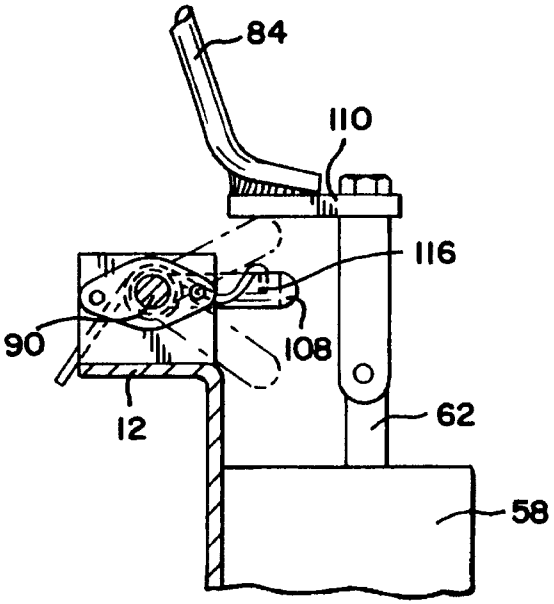
FIG. 7 is a sectional view taken along line 7—7 of FIG. 5.

As shown in FIGS. 3, 5 and 7, the end of shaft 90 opposite to leg portion 94 is operably associated with the linkage 84 connecting the controller 66 to the valve stem 62 of tilt valve 58. As shown, shaft 90 is provided with a camming surface 108 disposed a predetermined radial distance from the rocking axis 92 of shaft 90. In the illustrated embodiment, the camming surface 108 is adapted to engage with and move a generally horizonal follower plate 110 provided on the linkage 84. Thus, when shaft 90 rocks about axis 92 through a predetermined angle, the camming surface 108 engages the follower plate 110 thereby appropriately positioning the valve stem 62 and thereby the tilt valve 58 by automatically moving the linkage 84 so as to operate the hydraulic tilt cylinder 32 to maintain the bucket 24 in a predetermined disposition relative to the lift arms 20.

In the illustrated embodiment, and as shown in FIG. 5, the motion transfer mechanism 96 further includes a spring mechanism 114 for normally returning the shaft 90 to a neutral position when the lift arms 20 are lowered. As will be appreciated, in a neutral position, the anti-rollback mechanism 88 is ineffective to apply any compensating affect on the tilt valve 58. In a most preferred form of the invention, the spring mechanism 114 includes a coil spring 116 arranged about the shaft 90. One end of the coil spring engages with the frame 12. The other end of the coil spring 116 urges the camming surface 108 away from the follower plate 110 thus permitting the tilt valve 58 to freely operate without the effect of the anti-rollback mechanism 88 acting thereagainst.

It will be appreciated that when the lift arms 20 are raised, the bucket 24, if it remains in a fixed position relative to the arms 20, tends to tilt rearwardly. As a result, a load in the bucket 24 would be dumped back into the implement and onto the operator. During operation of the loader mechanism, the anti-rollback mechanism 88 is effective to automatically maintain the bucket 24 in a generally level disposition as the lift arms 20 are raised through a predetermined range of angular movement relative to the frame 12 of the implement 10.

As the lift arms 20 are raised, the distance between the location whereat the control rod 98 attaches to the bucket positioning linkage 38 and the pivot axis for the lift arms 20, defined by the pivot shaft 22, changes. That is, as the lift arms 20 are raised the distance between the location whereat the control rod 98 attaches to the rear bucket link 42 and the axis of pivot shaft 22 is reduced. Because the control rod 98 is of a fixed length, as the lift arms 20 are raised, the control rod 98 is pushed rearwardly thus causing bellcrank lever 100 to rock about pivot shaft 22. The rotation of the bellcrank lever 100 is transmitted into rocking movement of the rock shaft 90 about axis 92. Rocking movement of the rock shaft 90 will cause the camming surface 108 to engage the follower 110 thereby resulting in movement of the linkage 86 to effect movement of the tilt valve 58 in a manner controlling the hydraulic tilt cylinder 32 to maintain the bucket 24 in a generally level disposition.

As shown in FIG. 7, the camming surface 108 of rock shaft 90 is normally removed from engagement with the follower 110 when the lift arms 20 are arranged in a lower position. Thus, the anti-rollback mechanism 88 allows the control lever 68 to freely move thus providing the bucket with a full range of rolling movements as long as the lift arms 20 are in a lower range of their movement. As the lift arms are elevated, however, the camming surface 108 approaches the follower 110 and, ultimately, engages the follower 110 so as to influence operation of the hydraulic tilt cylinder 32.

In the illustrated embodiment, the anti-rollback mechanism 88 allows about a 6 foot elevational rise of the bucket 24 from the ground surface before the anti-rollback mechanism begins to impart any control over the controller 66 and the tilt valve 58. An advantage of the present invention is that the engaging relationship of the anti-rollback shaft 90 with the follower 110 can be modulated such that the elevational rise of the bucket 24 from the ground surface can be more or less than 6 feet prior to the anti-rollback mechanism 88 becoming effective to control the pivotal disposition of the bucket 24 relative to the lift arms.

As will be appreciated, the rotation of the bellcrank lever 100 about pivot shaft 22 is considerable during the initial raising of the lift arms 20 from their lower position. Thus, the camming surface 108 is normally removed from engagement with the follower 110, thus permitting a range of movement of the lift arms 20 prior to the mechanism 88 acting on tilt valve 58. In the preferred form of the present invention, the configuration of the cable 106 furthermore facilitates the ability of the lift arms 20 to have a predetermined angle of free rotation prior to the anti-rollback mechanism 88 becoming effective to control the tilt valve 32. That is, depending upon the degree of slack provided in the cable 106, the angular extent of movement of the lift arms 20 can be modulated prior to the anti-rollback mechanism 88 becoming effective to modulate operation of the hydraulic tilt cylinder 32 to maintain the bucket 24 in a generally level disposition as the lift arms 20 are raised.

Thus, there has been disclosed a mechanical, positive and adjustable mechanism for preventing rollback of a bucket in a loader mechanism on an off-highway implement into a position whereat rearward dumping of the bucket to the operator station can occur. The use of the anti-rollback shaft 90 avoids the need for several bellcranks and related pivot shafts, connecting rods and pins to transmit forces over a considerable distance and also with a proper ratio. Moreover, the use of the anti-rollback shaft 90 allows the anti-rollback mechanism of the present invention to fit within a combined spacial area.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. An off-highway implement having a fore-and-aft extending frame, a loader mechanism connected to the frame for generally vertical movements relative to the frame, said loader mechanism including a pair of loader arms pivotally attached to the frame toward one end thereof and having a bucket pivotally attached between and toward a second end of the arms, a powered mechanism operatively associated with said loader mechanism to effect movement thereof, said powered mechanism including a first linear actuator interconnecting said loader arms and said frame to effect said generally vertical movements of the loader arms and a second linear actuator interconnecting said loader arms and said bucket for controlling pivotal movements of the bucket relative to the loader arms, and a control mechanism operatively associated with said powered mechanism for controlling the linear actuators, said control mechanism comprising a controller connected to the frame to allow movement of an elongated handle about first and second pivot axes in both longitudinal and transverse directions, respectively, a valve body including a first valve interposed between said first actuator and a power source and connected through a first linkage to said controller for operating said first actuator in response to longitudinal movements of said handle about said first axis, and a second valve interposed between said second actuator and said power source and connected through a second linkage to said controller for operating said second actuator in response to transverse movements of said handle about said second axis, and an anti-rollback mechanism responsive to elevational movements of said loader arms for automatically positioning said second valve and thereby effecting operation of said second actuator to maintain said bucket in a generally level disposition as the loader arms are raised through a predetermined angle relative to the frame, and wherein said anti-rollback mechanism includes an anti-rollback shaft mounted on the frame of the implement and having a longitudinal axis about which said shaft rocks for transferring motion over a fore-and-aft extended distance, with a first end of said anti-rollback shaft being connected to a control member which rocks said anti-rollback shaft about said axis as the loader arms are raised through said predetermined angle relative to said frame, and with a second end of said anti-rollback shaft being adapted to move said second linkage thereby effecting operation of said second actuator to maintain said bucket at a generally level disposition as the loader arms are raised through said predetermined angle relative to said frame.

2. The off-highway implement according to claim 1 wherein said anti-rollback shaft has a predetermined range of free rocking movement to allow a range of elevational bucket movement before said second actuator is automatically operated to maintain said bucket in said generally level disposition.

3. The off-highway implement accordingly to claim 1 wherein a cable interconnects said control member and said anti-roll back shaft.

4. An off-highway implement having a fore-and-aft extending frame, lift arms pivotally mounted on said frame, a bucket pivotally mounted between the free ends of the lift arms, a hydraulic system including a first extendable/retractable hydraulic cylinder for elevationally positioning the arms and thereby the bucket relative to the frame, and a second extendable/retractable hydraulic cylinder for pivotally positioning the bucket relative to said lift arms, a source of pressurized hydraulic fluid connected to said first and second hydraulic cylinders through first and second valves, and a control mechanism connected to said valves for positioning said bucket relative to said frame, said control mechanism comprising a control lever connected to the frame for arcuate movement about first and second axes and wherein movement of said control lever about said first axis is transmitted to the first valve through a first linkage to elevationally position the bucket relative to the frame while movement of said control lever about said second axis is transmitted to the second valve through a second linkage to pivotally position the bucket relative to said lift arms, and an anti-rollback mechanism responsive to pivotal movements of said loader arms for automatically moving said control lever about said second axis thereby positioning said second valve to maintain said bucket in a generally level disposition as said loader arms are raised through a predetermined range of angular movement relative to the frame and wherein said anti-rollback mechanism includes an anti-rollback shaft defining a longitudinal fore-and-aft extending axis that is fixed relative to said frame and about which said shaft rotates to transfer motion over an extended fore-and-aft lengthwise distance to automatically position said second vane through engagement with said second linkage thereby maintaining said bucket at a generally level disposition as said lift arms are raised through said predetermined range of angular movement, and a motion transfer mechanism for rocking said shaft about said axis in response said lift arms moving through said predetermined range of angular movement relative to said frame.

5. The off-highway implement according to claim 4 wherein the motion transfer mechanism of said anti-rollback mechanism comprises a control rod connected at one end to at least one of said lift arms and at an opposite end to a pivotal member mounted on said frame.

6. The off-highway implement according to claim 5 wherein said motion transfer mechanism further includes a cable for allowing a predetermined angle of pivotal movement of said lift arms relative to said frame without imparting rocking movements to said shaft.

7. The off-highway implement according to claim 4 further including a spring mechanism for biasing said anti-rollback shaft out of engagement with said second linkage.

8. The off-highway implement according to claim 4 wherein said one end of said shaft is configured with a camming surface adapted to engage with a follower plate arranged in combination with said second linkage.

9. An off-highway implement having a fore-and-aft extending frame, lift arms pivotally mounted on said frame, a bucket connected between distal ends of said lift arms for rocking movements about a fixed axis, a hydraulic system including hydraulic lift cylinders connected to and between said frame and said lift arms for angularly displacing said arms and thereby elevationally positioning said bucket as a function of the operative length of the lift cylinders, hydraulic tilt cylinders connected to bucket positioning linkage for effecting rolling movements of said bucket, a source of pressurized hydraulic fluid, a lift valve operably interposed between said pressurized fluid source and said lift cylinders for angularly displacing said lift arms, a tilt valve operably interposed between said tilt cylinders and said pressurized source for controlling rolling movements of said bucket relative to the lift arms, and a single handle control mechanism mounted on the frame for generally universal movement in fore-and-aft and transverse directions toward and away from a neutral position, a first linkage connected to said lift vane and responsive to fore-and-aft movements of the handle for controlling elevational movements of the bucket, a second linkage connected to the tilt valve and responsive to transverse movements of the handle to control rolling movements of the bucket relative to the left arms, and an anti-rollback mechanism including a linkage mechanism mounted on the frame for engaging and moving the second linkage to control operation of the tilt valve in response to angular movements of the lift arms through a predetermined angle relative to said frame thereby automatically maintaining the bucket at a generally level disposition, wherein the linkage mechanism of said anti-rollback mechanism comprises a fore-and-aft extending anti-rollback shaft mounted on the frame of the implement for rocking movement about its longitudinal axis to transfer motion through a limited space and over an elongated fore-and aft distance, with said anti-rollback shaft engaging and moving the second linkage connecting said single handle to said tilt valve thereby controlling the rolled position of said bucket as a function of the angular displacement of said lift arms relative to said frame.

10. The off-highway implement according to claim 9 wherein said bucket positioning linkage includes a first link pivotally connected to said lift arms toward a first end and a second link pivotally connecting the second end of said first link to said bucket, and wherein said tilt cylinders are connected between said first link and said loader arms.

11. The off-highway implement according to claim 10 wherein the linkage mechanism of said anti-rollback mechanism further includes a control rod connected to said first link and to said anti-rollback shaft carded on said frame.

12. The off-highway implement according to claim 9 wherein said anti-rollback shaft has a predetermined range of rocking movement prior to engagement with said second linkage to allow a predetermined angle of elevational movement of the lift arms before said anti-rollback shaft engages said second linkage.

13. The off-highway implement according to claim 11 wherein the linkage mechanism of said anti-rollback mechanism includes a cable for connecting said control rod to said anti-rollback shaft.

14. The off-highway implement according to claim 11 wherein said anti-rollback mechanism further includes a spring for biasing said anti-rollback shaft out of engagement with said second linkage.

* * * * *